US009874178B2

(12) United States Patent
Koolmann et al.

(10) Patent No.: US 9,874,178 B2
(45) Date of Patent: Jan. 23, 2018

(54) INTERNAL COMBUSTION ENGINE

(71) Applicant: Mahle International GmbH, Stuttgart (DE)

(72) Inventors: Carsten Koolmann, Waiblingen (DE); Gerrit Simon, Stuttgart (DE)

(73) Assignee: Mahle International GmbH (DE)

( * ) Notice: Subject to any disclaimer, the term of this patent is extended or adjusted under 35 U.S.C. 154(b) by 367 days.

(21) Appl. No.: 14/618,547

(22) Filed: Feb. 10, 2015

(65) Prior Publication Data

US 2015/0226160 A1 Aug. 13, 2015

(30) Foreign Application Priority Data

Feb. 11, 2014 (DE) ..... 10 2014 202 439

(51) Int. Cl.

| | |
|---|---|
| ***F02M 25/07*** | (2006.01) |
| ***F01L 1/047*** | (2006.01) |
| ***F01L 1/344*** | (2006.01) |
| ***F01L 13/00*** | (2006.01) |
| ***F02M 26/22*** | (2016.01) |
| ***F02M 26/01*** | (2016.01) |

(52) U.S. Cl.

CPC ..... *F02M 25/0752* (2013.01); *F01L 1/047* (2013.01); *F01L 1/34413* (2013.01); *F01L 13/0036* (2013.01); *F02M 26/01* (2016.02); *F02M 26/22* (2016.02); *F01L 2001/0471* (2013.01); *F01L 2800/10* (2013.01)

(58) Field of Classification Search

CPC .... F02M 25/0752; F02M 26/01; F02M 26/22; F01L 1/047; F01L 1/34413; F01L 13/0036; F01L 2001/0471; F01L 2800/10

USPC ..... 60/605.2; 123/568.14, 90.6, 90.16, 123/90.18, 568.12; 74/567

See application file for complete search history.

(56) References Cited

U.S. PATENT DOCUMENTS 5,018,487 A * 5/1991 Shinkai ..... F01L 1/267 123/90.15
5,253,621 A * 10/1993 Dopson ..... F01L 1/143 123/90.16
5,287,830 A * 2/1994 Dopson ..... F01L 1/143 123/90.16

(Continued)

FOREIGN PATENT DOCUMENTS

DE 19914909 A1 10/2000
DE 102005015852 A1 10/2006

(Continued)

OTHER PUBLICATIONS

English abstract for DE-102010048050.

(Continued)

*Primary Examiner* — Thomas Moulis
*Assistant Examiner* — John Bailey
(74) *Attorney, Agent, or Firm* — Fishman Stewart PLLC

(57) ABSTRACT

An internal combustion engine may include at least one camshaft that may have an outer shaft and an inner shaft that is adjustable relative to the outer shaft. At least one first cam may be fixedly connected to the outer shaft for actuating an outlet valve. At least one second cam may be fixedly connected to the inner shaft. The at least one second cam, in an activated angular position, may enable an internal exhaust gas recirculation via actuating the outlet valve.

20 Claims, 2 Drawing Sheets

(56) References Cited

U.S. PATENT DOCUMENTS 5,347,962 A * 9/1994 Nakamura ..... F01L 1/267 123/90.16
8,225,759 B2 * 7/2012 Wutzler ..... F01L 13/0036 123/90.15
8,342,146 B2 * 1/2013 Schuler ..... B23P 11/00 123/90.44
8,596,235 B2 * 12/2013 Arnold ..... F01L 13/0005 123/90.16
8,820,281 B2 * 9/2014 Dietel ..... F01L 1/08 123/90.16
9,032,941 B2 * 5/2015 Dean ..... F02D 41/006 123/568.13
9,581,058 B2 * 2/2017 Radulescu ..... F01L 13/0021
9,593,602 B2 * 3/2017 Neukirchner ..... F01L 1/267
9,605,603 B2 * 3/2017 Glugla ..... F02D 19/10
2001/0054403 A1 * 12/2001 Fujii ..... F01L 1/0532 123/90.15
2004/0003789 A1 * 1/2004 Kreuter ..... F01L 1/185 123/90.16
2004/0050353 A1 * 3/2004 Williams ..... F01L 1/047 123/90.18
2004/0055548 A1 * 3/2004 Williams ..... F01L 1/022 123/90.15
2005/0016496 A1 * 1/2005 Hitomi ..... F01L 1/053 123/305
2007/0215082 A1 * 9/2007 Kido ..... F01L 1/181 123/90.16
2008/0215228 A1 * 9/2008 Krebber-Hortmann F02M 26/01 701/103
2009/0178634 A1 * 7/2009 Lancefield ..... F01L 1/047 123/90.16
2010/0242930 A1 * 9/2010 Shinohara ..... F02D 13/0265 123/568.14
2010/0288218 A1 * 11/2010 Meintschel ..... F01L 1/053 123/90.18
2012/0023934 A1 * 2/2012 Pursifull ..... F02M 26/42 60/605.2
2012/0023935 A1 * 2/2012 Pursifull ..... F02D 13/0207 60/605.2
2012/0125273 A1 * 5/2012 Werler ..... F01L 13/0036 123/90.6
2012/0160197 A1 * 6/2012 Matsunaga ..... F01L 1/0532 123/90.15
2012/0260870 A1 * 10/2012 Wahl ..... F01L 1/053 123/90.6
2013/0186357 A1 * 7/2013 Keel ..... F01L 1/34 123/90.16
2013/0255612 A1 * 10/2013 Zurface ..... F01L 1/18 123/90.16
2013/0312681 A1 * 11/2013 Schultheis ..... F01L 1/185 123/90.16
2013/0340427 A1 * 12/2013 Gonzalez Delgado ... F02D 9/04 60/605.2
2014/0013739 A1 * 1/2014 Gonzalez Delgado F02M 26/01 60/605.2
2014/0026874 A1 * 1/2014 Dean ..... F02D 21/08 123/568.21
2014/0144414 A1 * 5/2014 Dean ..... F02M 26/01 123/568.14
2014/0190431 A1 * 7/2014 McCarthy, Jr. ..... F01L 1/18 123/90.16

FOREIGN PATENT DOCUMENTS

DE 102005031241 A1 1/2007
DE 60309536 T2 8/2007
DE 102010048050 A1 4/2012
JP H07180515 A 7/1995
WO WO-2009/024170 A1 2/2009

OTHER PUBLICATIONS

English abstract for DE-60309536.
English abstract for DE-102005015852.
English abstract for DE-19914909.
English abstract for JP-H07180515.
Search Report for EP15152072.3, dated Jun. 11, 2015.

* cited by examiner

INTERNAL COMBUSTION ENGINE

CROSS-REFERENCE TO RELATED APPLICATIONS

This application claims priority to German Patent Application No. 10 2014 202 439.0, filed Feb. 11, 2014, the contents of which are hereby incorporated by reference in their entirety.

TECHNICAL FIELD

The invention relates to an internal combustion engine having at least one camshaft.

BACKGROUND

A generic internal combustion engine having a camshaft connected to a valve via a rocker is known from DE 603 09 536 T2. The camshaft has main cams that are used for initiating a full valve opening, as well as additional cams that are used for initiating a partial valve opening that has an exhaust gas recirculation function. The exhaust gas recirculation rate is controlled via a valve actuation system or a valve clearance control device that acts on the rocker arm via a bushing and, depending on the rotation of the bushing and by means of a tiltably mounted extension piece, it causes the rocker arm to roll only over the main cam profile or additionally over the additional cam profile. If the rocker arm rolls over the additional cam profile, the outlet valve of the internal combustion engine is kept open longer or is reopened for a second separate lift and thereby enables an internal exhaust gas recirculation.

However, a frequent disadvantage of the valve actuation systems for internal recirculation known from the prior art is that they are arranged in the region of the oscillating rocker arms and as a result of this, a comparatively large amount of energy has to be provided just for their movement.

SUMMARY

The present invention therefore is concerned with the problem of providing an improved or at least an alternative embodiment for an internal combustion engine, which is in particular characterized by lower energy operation.

This problem is solved according to the invention by the subject matter of the independent claim(s). Advantageous embodiments are subject matter of the dependent claims.

The present invention is based on the general idea of arranging a valve actuation system for internal exhaust gas recirculation no longer at the oscillating rocker arm or cam followers, but rather to implement a cam-in-cam solution so that the entire switching mechanism for the internal exhaust gas recirculation can be operated with significantly less energy. For this purpose, the internal combustion engine has at least one camshaft which, according to the invention, comprises an outer shaft and an inner shaft that can be adjusted relative to the latter. First cams for actuating an outlet valve are fixedly connected to the outer shaft, whereas additionally, second cams are provided fixedly connected to the inner shaft which, in an activated angular position, enable the internal exhaust gas recirculation by extended opening of the outlet valve or by opening it a second time. In contrast to the internal combustion engines known from the prior art, the internal combustion engine according to the invention no longer requires the energy input for the oscillating movement of the mass of the valve actuation system since this is now integrated according to the invention in the adjustable camshaft.

In an advantageous refinement of the solution according to the invention, a second cam is arranged in each case between two first cams or vice versa. The first alternative can be referred to as a so-called multiple cam that is composed of a total of three cams, namely two outer first cams and one inner second cam. The inner second cam, by means of which the internal exhaust gas recirculation is enabled, is connected to the inner shaft in a rotationally fixed manner via a pinned fitting, whereas the second cams are arranged rotationally fixed on the outer shaft. As an alternative it is also conceivable that a pair of first cams and a pair of second cams are in each case arranged adjacent to one another.

If the second cams are in their activated angular position, a cam follower or rocker arm actuating the respective outlet valve rolls over the cam profile of the first cam and additionally over the cam profile of the second cam. If in the process of this, the cam profile of the second cam is situated within the cam profile of the first cam, no exhaust gas recirculation takes place, but rather takes place only when the cam profile of the second cam protrudes beyond that of the first cam. During the internal exhaust recirculation, the outlet valve is closed later or is reopened for a second separate lift so that during the intake process of the internal combustion engine at least a certain portion of exhaust gas is sucked in again.

In another advantageous embodiment of the solution according to the invention, a continuous transition is formed between the first cam and the activated second cam. In order to ensure operation of the internal combustion engine as quiet and smooth as possible, a rolling track of the rocker arm or the cam follower should have no kinks or steps even in the case of an activated second cam. The continuously formed transition between the first cam profile and the second cam profile thus ensures a particularly quiet and smooth operation of the internal combustion engine.

Advantageously, the internal combustion engine has a low-pressure exhaust gas recirculation system which optionally can additionally comprise a cooling system for cooling the recirculated exhaust gas. For example, such a low-pressure exhaust gas recirculation feeds exhaust gas extracted downstream of the turbine of an exhaust turbocharger back to the internal combustion via a corresponding line, wherein a cooling system, for example an exhaust gas cooler, can be additionally arranged in this line in order to achieve an increase in performance. By decreasing the temperature of the recirculated exhaust gas, the same volume contains a greater air mass, so that proportionally more fuel can be combusted in the internal combustion engine. Thus, such an exhaust gas cooler serves primarily for increasing the performance of the internal combustion engine, wherein the low-pressure exhaust gas recirculation system is of course provided purely optionally.

Further important features and advantages of the invention arise from the sub-claims, from the drawings, and from the associated description of the figures based on the drawings.

It is to be understood that the above-mentioned features and the features still to be explained hereinafter are usable not only in the respective mentioned combination, but also in other combinations or alone, without departing from the context of the present invention.

Preferred exemplary embodiments of the invention are illustrated in the drawings and are explained in more detail in the following description, wherein identical reference numbers refer to identical or similar or functionally identical components.

BRIEF DESCRIPTION OF THE DRAWINGS

In the figures, schematically.

DETAILED DESCRIPTION

Figure 1:
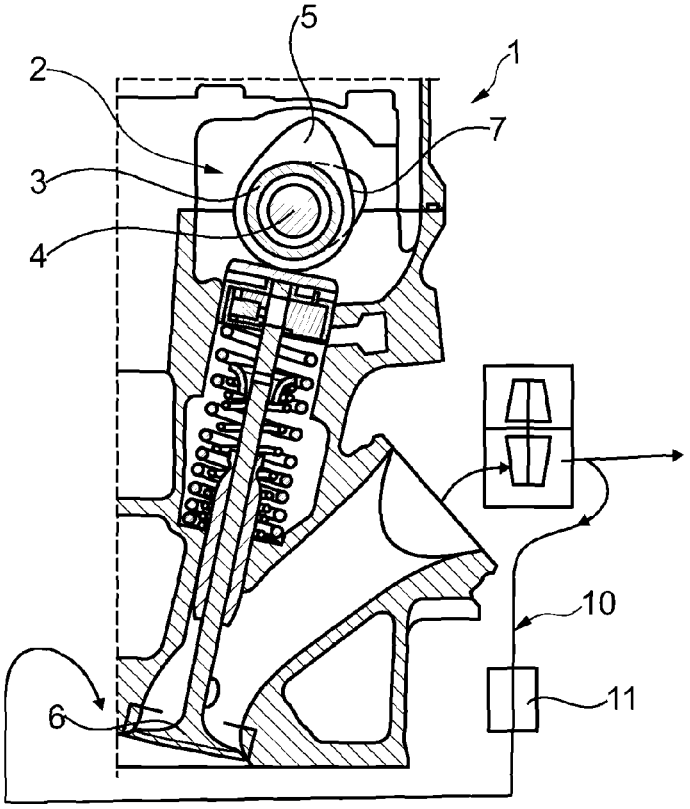
FIG. 1 shows a sectional view through an internal combustion engine according to the invention.

According to FIG. 1, an internal combustion engine 1 according to the invention has a camshaft 2 with an inner shaft 4 that is adjustable relative to an outer shaft 3. First cams 5 for actuating an outlet valve 6 are arranged on the outer shaft 3 and are fixedly connected thereto. According to the invention, second cams 7 are now provided which are fixedly connected to the inner shaft 4 and which, in an activated angular position as illustrated according to FIG. 1 and the right illustration in FIGS. 3 and 5, enable internal exhaust gas recirculation. Such internal exhaust gas recirculation takes place if the outlet valve 6 is at least temporarily still open during the intake process of the internal combustion engine 1, that is, when the intake valve is open, so that during the intake of the internal combustion 1 not only a fuel-air mixture is taken in, but, at the same time, some of the exhaust gas is also taken into the combustion chamber via the exhaust valve 6.

Figure 2:
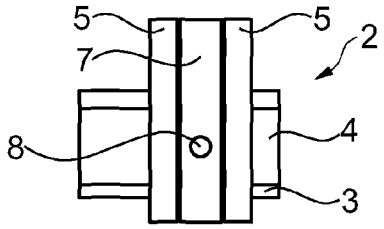
FIG. 2 shows a side view of a camshaft according to the invention.

According to FIG. 2 it is illustrated that a second cam 7 is arranged in each case between two first cams 5. The second cam 7 is connected to the inner shaft 4 in a rotationally fixed manner via a pin 8, wherein the pin passes through an elongated opening that extends in the circumferential direction. In order to enable operation of the internal combustion engine 1 at a noise level as low as possible, a transition 9 between the first cam 5 and the activated second cam 7 is formed continuously, which is shown approximately in the right illustration of FIG. 3.

In addition to the internal exhaust gas recirculation, the internal combustion engine 1 can of course also have a low-pressure exhaust gas recirculation system 10, which extracts exhaust gas downstream of an exhaust turbocharger 11 and feeds it back again to a combustion chamber of the internal combustion engine 1. Moreover, a cooling system 11 for cooling the recirculated exhaust gas can be arranged in the region of the low-pressure exhaust gas recirculation system 10.

Figure 3:
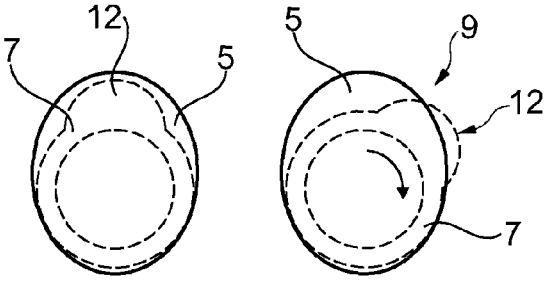
FIG. 3 shows a sectional view through two cams placed one above the other.

According to FIG. 3, a sectional view through the camshaft 2 according to the invention is shown, wherein in the illustration on the left, the second cam 7 is arranged within the cam profile of the first cam 5, thus is not activated, whereas in the illustration on the right, the second cam is rotated with respect to the first cam 5 so that its cam lobe 12 protrudes beyond the cam profile of the first cam 5. The outlet valve 6 is opened again or is temporarily kept open longer by means of this cam lobe 12 so that exhaust gas can be internally recirculated during an intake process of the internal combustion engine 1.

Figure 4:
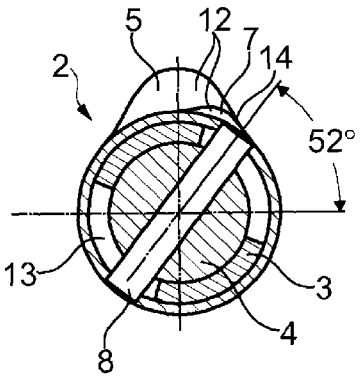
FIG. 4 shows an illustration as in FIG. 2, but with the first/second cams arranged and formed differently.
Figure 4:
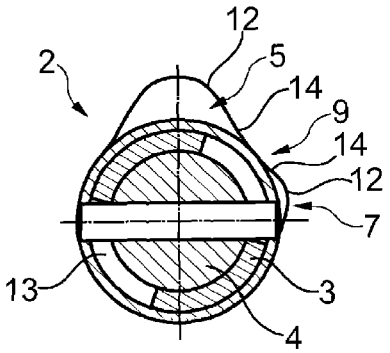
Figure 4:
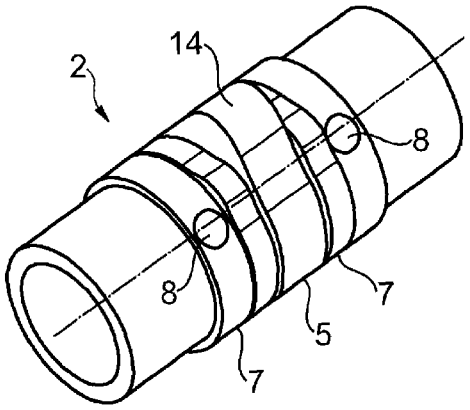
Figure 5:
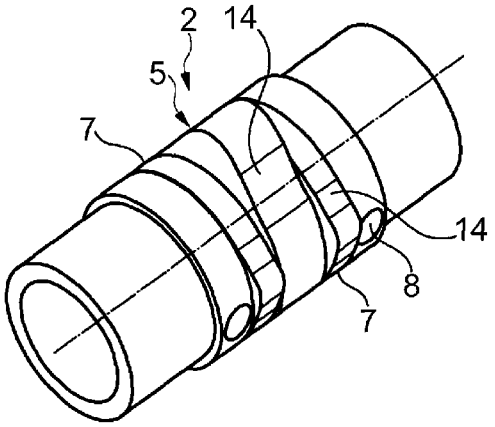
FIG. 5 shows an illustration as in FIG. 4, but with the second cam activated.

According to FIGS. 4 and 5, a camshaft 2 is illustrated on which a first cam 5 is arranged in each case between two second cams 7. The second cam 7 is connected to the inner shaft 4 in a rotationally fixed manner via a pin 8, wherein the pin passes through an elongated opening 13 that extends in the circumferential direction. In order to enable an operation of the internal combustion engine 1 at a noise level as low as possible, a transition 9 between the first cam 5 and the activated second cam 7 is formed continuously. Of course, it is not absolutely necessary for this transition 9 to be formed continuously, as is clearly shown according to FIG. 3. In order to implement the continuous transition 9, the cam lobes 12 of the first and/or the second cam 5, 7 can have a chamfer 14 at the transition 9. According to FIG. 4, no internal exhaust gas recirculation takes place since the cam profile of the second cam 7 is situated within the cam profile of the first cam 5. In contrast to this, exhaust gas is recirculated according to FIG. 5.

With the adjustable camshaft 2 according to the invention and in particular with the second cam 7 it is therefore possible for the first time to implement internal exhaust gas recirculation where the additional mass for controlling the exhaust gas recirculation rate is not located on a rocker arm or cam follower and thus has to be moved in a complicated manner in order to oscillate, but instead can be integrated for the first time as a rotating mass in the camshaft 2, which is significantly more energy efficient.

The invention claimed is:

1. An internal combustion engine, comprising:

at least one camshaft including an outer shaft and an inner shaft adjustable relative to the outer shaft;

at least one first cam including a first cam lobe and fixedly connected to the outer shaft for actuating an outlet valve;

at least one second cam including a second cam lobe and fixedly connected to the inner shaft, the at least one second cam rotatable with respect to the at least one first cam, wherein the at least one second cam is arranged to facilitate an internal exhaust gas recirculation via actuating the outlet valve when the at least one second cam is rotated into an activated angular position;

wherein the at least one second cam in the activated angular position is arranged with respect to the at least one first cam to provide a continuous transition in a circumferential direction of the at least one camshaft between a first cam profile of the at least one first cam and a second cam profile of the at least one second cam; and wherein at least one of the first cam lobe of the at least one first cam and the second cam lobe of the at least one second cam has a chamfer to provide the continuous transition between the first cam profile and the second cam profile when the at least one second cam is in the activated angular position.

2. The internal combustion engine according to claim 1, wherein at least one of (i) the at least one second cam is arranged between at least two first cams and (ii) the at least one first cam is arranged between at least two second cams.

3. The internal combustion engine according to claim 1, wherein the at least one first cam is arranged adjacent to the at least one second cam.

4. The internal combustion engine according to claim 1, wherein the internal combustion engine is a diesel engine.

5. The internal combustion engine according to claim 1, further comprising a low-pressure exhaust gas recirculation system for communicating a recirculated exhaust gas flow.

6. The internal combustion engine according to claim 5, wherein the low-pressure exhaust gas recirculation system has a cooling system for cooling the recirculated exhaust gas flow.

7. The internal combustion engine according to claim 1, wherein the at least one second cam is rotationally offset from the at least one first cam in the activated angular position.

8. The internal combustion engine according to claim 7, wherein at least one of (i) the at least one second cam is arranged between at least two first cams and (ii) the at least one first cam is arranged between at least two second cams.

9. The internal combustion engine according to claim 7, wherein the at least one first cam is arranged adjacent to the at least one second cam.

10. The internal combustion engine according to claim 1, wherein the second cam lobe is rotationally offset from the first cam lobe in the activated angular position of the at least one second cam.

11. The internal combustion engine according to claim 10, wherein the second cam lobe protrudes beyond the first cam profile defined by the first cam lobe with respect to the circumferential direction in the activated angular position of the at least one second cam.

12. The internal combustion engine according to claim 10, wherein the at least one first cam is arranged adjacent to the at least one second cam.

13. The internal combustion engine according to claim 10, wherein the at least one second cam is rotationally fixed to the inner shaft via a pin having a pin axis extending radially through the at least one second cam and the inner shaft, and wherein the pin axis is arranged perpendicular to a radial axis passing through the first cam lobe and the outer shaft when the at least one second cam is in the activated angular position to facilitate the continuous transition between the first cam profile and the second cam profile.

14. The internal combustion engine according to claim 10, wherein the first cam lobe is provided with the chamfer, and wherein the second cam lobe protrudes beyond the first cam profile defined by the first cam lobe and the chamfer with respect to the circumferential direction in the activated angular position of the at least one second cam.

15. The internal combustion engine according to claim 5, wherein the at least one first cam is arranged adjacent to the at least one second cam.

16. A camshaft for an internal combustion engine, comprising:

an outer shaft;

an inner shaft arranged coaxially with the outer shaft and rotationally adjustable with respect to the outer shaft;

at least one first cam fixedly connected to the outer shaft for actuating an outlet valve, the at least one first cam including a first cam lobe and defines a first cam profile;

at least one second cam fixedly connected to the inner shaft for actuating the outlet valve, the at least one second cam including a second cam lobe and defines a second cam profile, wherein the at least one second cam is rotationally adjustable with respect to the at least one first cam between a non-activated angular position where the second cam lobe is arranged within the first cam profile with respect to a circumferential direction, and an activated angular position where the second cam lobe is arranged rotationally offset from the first cam profile with respect to the circumferential direction; and wherein the second cam lobe in the activated angular position of the at least one second cam protrudes beyond the first cam profile defined by the first cam lobe in the circumferential direction and provides a continuous transition in the circumferential direction between the first cam profile at the first cam lobe of the at least one first cam and the second cam profile at the second cam lobe of the at least one second cam to facilitate an internal exhaust gas recirculation via actuating the outlet valve.

17. The camshaft according to claim 16, wherein the first cam lobe of the at least one first cam has a first chamfer and the second cam lobe of the at least one second cam has a second chamfer, the first chamfer and the second chamfer disposed at the continuous transition provided along the circumferential direction between the first cam profile and the second cam profile in the activated angular position of the at least one second cam.

18. The camshaft according to claim 17, wherein the continuous transition is defined in the circumferential direction by a radially inwardly sloping face extending along one of the first cam profile and the second cam profile that transitions into a radially outwardly sloping face extending along the other of the first cam profile and the second cam profile in the activated angular position of the at least one second cam.

19. The camshaft according to claim 18, wherein the first cam profile is defined by the first cam lobe and the first chamfer and the second cam profile is defined by the second cam lobe and the second chamfer to provide the continuous transition from the radially inwardly sloping face to the radially outwardly sloping face in the circumferential direction.

20. The camshaft according to claim 16, wherein at least one of (i) the at least one second cam is arranged between at least two first cams and (ii) the at least one first cam is arranged between at least two second cams.

* * * * *